US010130871B2

(12) United States Patent
Woody

(10) Patent No.: US 10,130,871 B2
(45) Date of Patent: Nov. 20, 2018

(54) CRANE TEAMWORK BUILDING GAME

(71) Applicant: James O Woody, Riverton, UT (US)

(72) Inventor: James O Woody, Riverton, UT (US)

( * ) Notice: Subject to any disclaimer, the term of this patent is extended or adjusted under 35 U.S.C. 154(b) by 0 days.

(21) Appl. No.: 15/874,633

(22) Filed: Jan. 18, 2018

(65) Prior Publication Data

US 2018/0207521 A1 Jul. 26, 2018

Related U.S. Application Data

(60) Provisional application No. 62/449,662, filed on Jan. 24, 2017.

(51) Int. Cl.
*A63F 9/30* (2006.01)

(52) U.S. Cl.
CPC ..... *A63F 9/30* (2013.01); *A63F 2250/485* (2013.01); *A63F 2250/604* (2013.01)

(58) Field of Classification Search
CPC . A63F 9/30; A63F 2250/485; A63F 2250/604
See application file for complete search history.

(56) References Cited

U.S. PATENT DOCUMENTS

| | | | | |
|---|---|---|---|---|
| 3,747,929 | A | 7/1973 | Burke | |
| 3,936,051 | A | 2/1976 | Walker, Jr. | |
| 4,346,884 | A | 8/1982 | Warehime | |
| 4,915,394 | A | 4/1990 | Kramer | |
| 6,428,008 | B1 * | 8/2002 | Singer | B60P 3/025 273/447 |
| 7,080,840 | B1 * | 7/2006 | Chen | A63F 9/30 273/447 |
| 8,662,899 | B1 | 3/2014 | Alayoub | |
| 9,526,978 | B1 * | 12/2016 | Shoemaker, Jr. | G07F 17/3209 |
| 2008/0090629 | A1 * | 4/2008 | Matsuda | A63F 9/30 463/7 |
| 2012/0025469 | A1 * | 2/2012 | Shiino | A63F 9/30 273/447 |
| 2012/0056381 | A1 * | 3/2012 | Shiino | A63F 9/30 273/448 |
| 2018/0207521 | A1 * | 7/2018 | Woody | A63F 9/30 |

OTHER PUBLICATIONS www.palossports.com, Bucket Ball Transfer, accessed on Oct. 25, 2016 from www.palossports.com.
www.everlastclimbing.com, Dinosaur Egg Transfer, accessed on Oct. 25, 2016 from www.everlastclimbing.com.
www.palossports.com, Meteorite Mission, accessed on Nov. 10, 2016 from www.palossports.com.

* cited by examiner

*Primary Examiner* — Raleigh W Chiu
(74) *Attorney, Agent, or Firm* — Pate Peterson PLLC; Brett Peterson

(57) ABSTRACT

A crane game is provided for amusement, training, and team building purposes. The body of the crane is suspended beneath manually held handles which are attached to the crane body by cords. Two lifting hooks are suspended beneath the crane body and operated by lifting lines which engage the crane body and extend outwardly from the crane body. Multiple persons each control a handle or lifting line and operate the crane through coordinated movement of the handles and lifting lines.

14 Claims, 17 Drawing Sheets

CRANE TEAMWORK BUILDING GAME

RELATED APPLICATIONS

The present claims the benefit of U.S. Provisional Application Ser. No. 62/449,662, filed Jan. 24, 2017, which is expressly incorporated herein by reference in its entirety.

THE FIELD OF THE INVENTION

The present invention relates to teamwork building games. In particular, examples of the present invention relates to a crane system which allows multiple persons to cooperate together in order to move a target object.

BACKGROUND

Games provide an important source of entertainment as well as building skill, friendship, and comradery. Games have proven valuable among friends as well as among coworkers in business settings. The present disclosure includes a game which presents particular challenges in coordinating simultaneous efforts between many different people who are playing the game. The game is useful to increase friendship and for teambuilding as it requires close cooperation between the players.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1A:
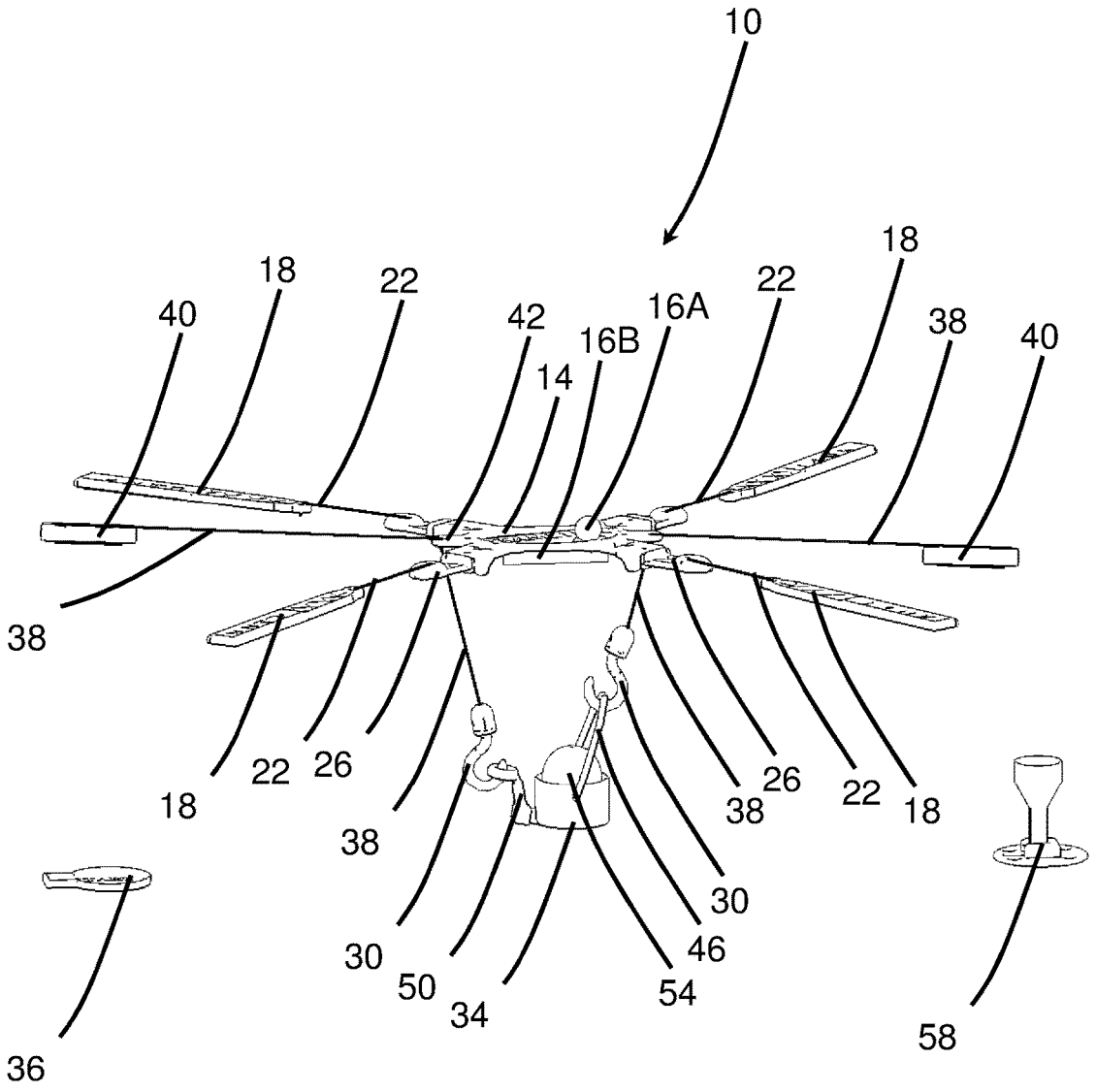
FIG. 1A is a drawing which shows a crane toy of the present invention.

Corresponding reference characters indicate corresponding components throughout the several views of the drawings. Skilled artisans will appreciate that elements in the figures are illustrated for simplicity and clarity and have been drawn to scale to facilitate understanding. The dimensions of some of the elements in the figures may be exaggerated relative to other elements or to other figures to help improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which are shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art. The drawings are drawn to scale to facilitate understanding of the invention.

Figure 1B:
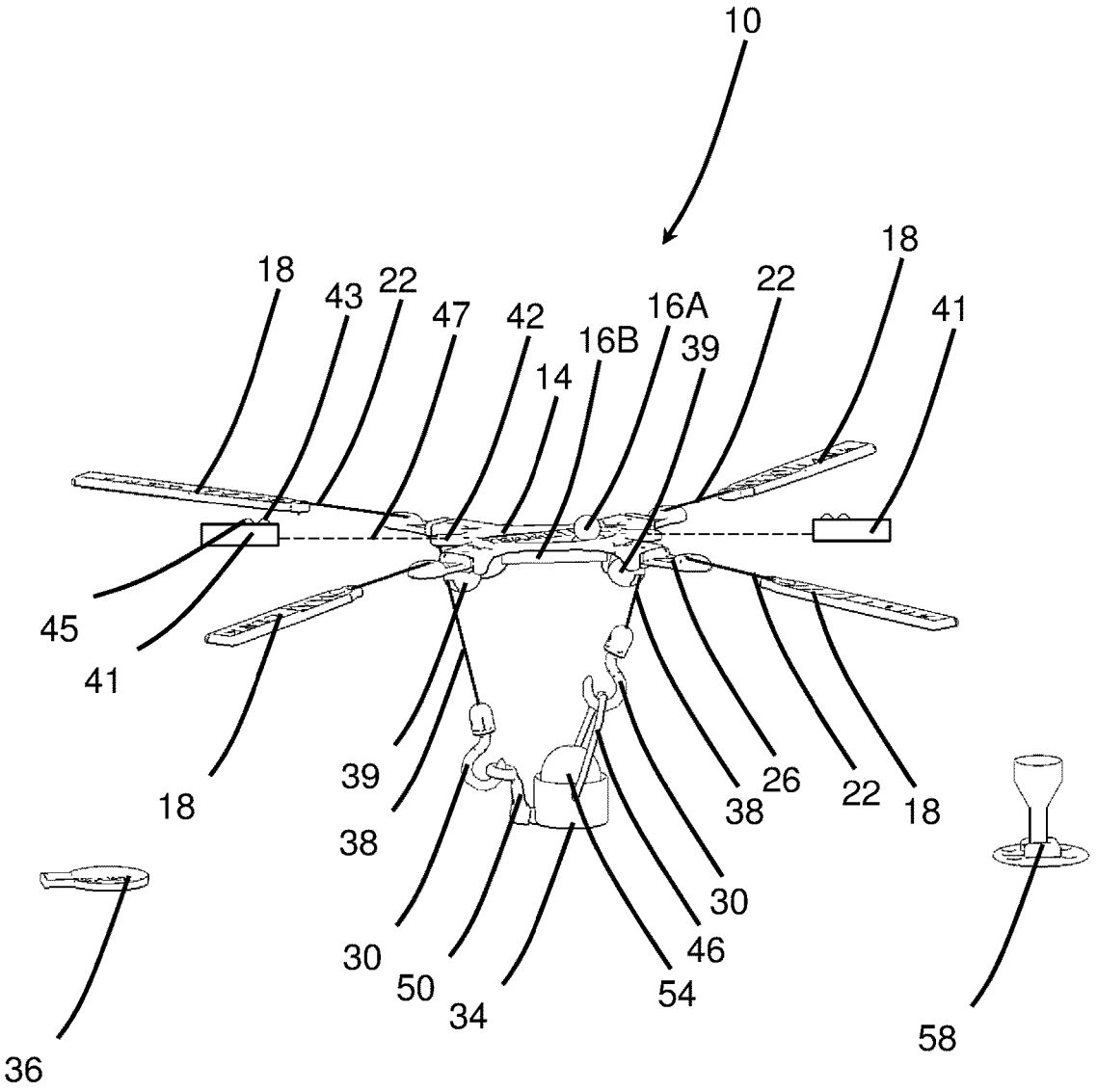
FIG. 1B is a drawing which shows the crane toy of FIG. 1A with electrical lifting hooks.
Figure 1C:
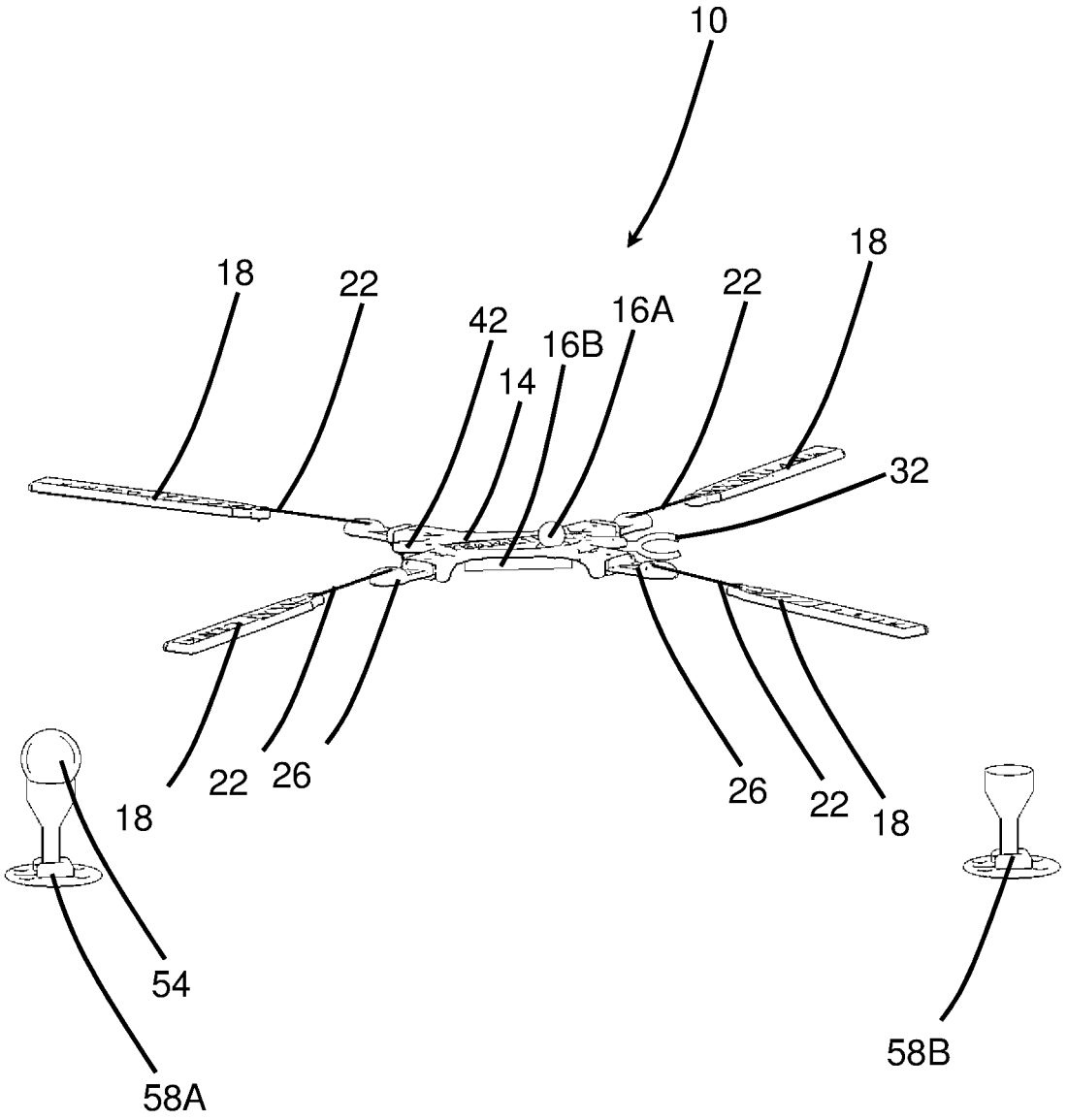
FIG. 1C is a drawing which shows the crane toy of FIG. 1A with a simplified hook system.

In the drawings, FIGS. 1A through 1C show overall drawings of the crane game 10. FIGS. 2 through 8 show more detailed drawings of different components of the crane game 10 of FIGS. 1A through 1C. FIGS. 9 through 13 show drawings which show how the crane game 10 of FIGS. 1A through 1C may be used. In some figures, not all structures are numbered to avoid difficulty in viewing the structure of the crane 10.

Turning now to FIG. 1A, the crane game 10 includes a crane body 14. The crane body 14 provides a deck or chassis which interacts with the other pieces to form the overall crane 10. The body 14 is attached to multiple handles 18 which are used to move the crane 10. As shown, four handles 18 may be used to move the body 14. Each of the handles 18 is attached to the body with a flexible structure, such as with a cord 22. In one example, the cord 22 may be a length of elastic cord. The cord 22 between the each handle 18 and the body 14 may be between about ½ and about 10 feet long, and is often between about 2 and about 4 feet long. The length of the cord 22 and the flexible nature of the cord 22 create difficulty in coordinating the motion of the body 14. In use, each handle 18 is held by a different person and these persons must coordinate their movement in order to move the body 14 into a desired position. Since each handle 18 is attached to the body 14 by a flexible member, movement of a handle 18 does not directly translate into movement of the body 14 and each handle 18 must be moved carefully to move the body 14 in a desired manner. The cords 22 may be flexible but relatively inelastic along their length, or may be an elastic cord which stretches along its length. Using the crane 10 is made more difficult if the cords 22 are elastic cords. It will be appreciated that each person holding a handle 18 will be several feet from the body 14 and from each other due to the length of the cords 22 and their movement will need to be coordinated with movement made by another person to move the body 14 precisely.

The body 14 may have a number of arms 26 which extend from a central portion and which provide an attachment location for the cords 22. As shown, the body 14 has four arms 26 corresponding to four handles 18 and cords 22. In one design, the arms 26 may have removable ends which are connected to the arms 26 to provide the cord attachment or which may be switched for an alternate structure, such as a rigid handle without cord 22. These removable ends may attach to the arms 26 with a snap in socket-type joint.

A significant challenge in using the crane 10 is moving the crane body 14 in a coordinated manner and keeping the body 14 in a relatively level orientation. The crane 10 may include an alarm system which indicates if the crane body 14 has been tilted too far from level. In one example, the crane 10 may include a ball 16A which is placed into a hole on the crane body 14 so that the ball is resting in the hole. The hole is smaller in diameter than the ball 16A so that the ball does not fit completely within the hole. The diameter of the hole may be about one half the diameter of the ball 16A. If the crane body 14 is tilted too much, the ball 16A will roll out of the hole and fall off of the crane body 14, indicating that the game challenge has not been met. The diameter of the hole may be selected to provide a desired permissible angle of tilt for the body 14 without dropping the ball 16A. A smaller diameter hole will allow the ball 16A to fall off of the body 14 more easily and at a smaller angle while a larger diameter hole will allow the ball 16A to fall off at a larger angle.

In another example, the body 14 may have an electronics box 16B attached to the body. The electronics box 16B includes an electronic system for monitoring the tilt and movement of the body 14. The electronics system may use a sensor and computer processor to monitor the motion of the body and use a visual or audible alarm if the game parameters are exceeded.

The crane 10 includes lifting hooks 30 which are suspended beneath the body 14. In the example crane 10, two lifting hooks 30 are used. Each of the lifting hooks 30 is attached to a first end of a lifting line 38. The lifting line 38 extends upwardly from the lifting hook 30, is supported by the body, and extends away from the body to a person who is operating the lifting line 38 and associated lifting hook 30. The second end of the lifting line 38 may be attached to a lifting handle 40. The body 14 may include a pulley or the like to support the lifting line 38. Typically, however, the lifting line 38 may simply pass through a smooth hole 42 formed in the body 14 which allows the lifting line 38 to slide back and forth through the hole 42. Each person who is operating the lifting hook 30 will pull the handle 40 and lifting line 38 away from the body 14 to raise the hook 30 or will move the handle 40 and lifting line 38 towards the body 14 to lower the lifting hook 30. The lifting lines 38 for the lifting hooks 30 may be elastic cords, but typically are inelastic cords so that operation of the bucket is not overly complicated.

The lifting hooks 30 are used to operate a crane bucket 34. In the example shown, two lifting hooks 30 are used to operate the bucket 34. One lifting hook 30 is used to capture a bale or handle 46 on the bucket and carry the bucket 34. Another lifting hook 30 is used to capture a pivot arm 50 which extends from a side of the bucket 34. The pivot arm 50 is used to control the attitude (e.g. angle) of the bucket 34 and tilt the bucket 34 sideways to scoop an object into the bucket 34 or dump an object out of the bucket 34. Thus, two persons control the bucket 34 via the lifting hooks 30. While one lifting hook 30 is primarily responsible for controlling the height of the bucket 34 above the ground and another lifting hook 30 is primarily responsible for controlling the attitude of the bucket 34 and tilting the bucket 34, these functions are intermixed and lifting or lowering the bucket via the lifting hook 30 attached to the handle 46 without simultaneously lifting or lowering the lifting hook 30 attached to the pivot arm 50 will change the attitude of the bucket 34 and is likely to dump an object out of the bucket 34. The bucket 34 may be placed onto a starting pad 36 at the beginning of the game. The pivot arm 50 and bucket 34 can be constructed to allow the pivot arm 50 to twist and pivot with respect to the bucket 34, allowing the bucket 34 to dump its contents more easily. If the bucket is so designed, the starting pad 36 can stabilize the pivot arm 50 and hold it in an upright position to make it easier for a person to capture the pivot arm with a hook 30.

The crane 10 is typically used in combination with a payload object 54 and a destination receptacle 58. The payload object 54 is an object which is small enough to be carried in the crane bucket 34. In one example, a ball or egg shaped piece of plastic may be used as the payload object 54. The persons using the crane 10 must use the crane movement handles 18 and lifting hook handles 40 to maneuver the crane 10 into a desired position and to scoop the payload object 54 into the bucket 34. An egg shaped payload object 54 will provide a challenge as the egg will roll in many directions and must be approached carefully to successfully place the egg into the bucket 34. The persons using the crane 10 must each cooperate to simultaneously control the height of the crane body 14 and bucket 34, the location and direction of movement of the crane body 14 and bucket 34, and the tilting of the crane bucket 34 in order to successfully place the payload object 54 into the bucket 34. Once the payload object 54 is in the bucket 34, the persons can move the crane 10 into position over the destination receptacle 58 and carefully move the crane body 14 and bucket 34 to place the payload object 54 into or onto the destination receptacle 58. It is appreciated that each task or movement of the crane 10 requires careful cooperation between the persons using the crane in order to be successful. For example, moving the crane body 14 without also moving the lifting cords 38 will cause the bucket 34 to change height or tip over and empty its contents. To reduce the difficulty, the game may be started with the payload object 54 in the bucket.

Turning now to FIG. 1B, the crane game 10 is shown with electric lifting hooks. For clarity, some of the elements are not numbered to facilitate the numbering of the additional structures not shown in FIG. 1A. In discussing FIG. 1B, the differences from FIG. 1A are discussed and it is understood that, unless otherwise noted, FIG. 1B includes the structures of FIG. 1A and operates in like manner. Instead of lifting hook handles 40 attached to lifting cords 38, the crane 10 may include electrical lifting motors 39 which are attached to the lifting cords 38 and operate to raise and lower the lifting hooks 30. The electric lifting motors 39 may be, for example, a unitary lifting system which includes an electrical motor connected to a planetary gearbox which is in turn connected to a spool. The lifting cords 38 are attached to the spool and are wound on to or extended from the spool via rotation of the spool. The planetary gear box provides the necessary torque and speed reduction; providing control over the height of the lifting hook 30. The electrical lifting motor 39 may be connected to the electronic system 16B and may receive power from the battery which forms part of the electronic system 16B. The electrical lifting motor 39 may be connected to a lifting controller 41 which is grasped by a user who is controlling the associated lifting hook 30. The lifting controller 41 includes an up button 43 and a down button 45 to control the lifting hook 30 via the lifting motor 39. The lifting controller 41 may be connected to the lifting motor 39 via a wire 47, or may alternatively be connected wirelessly to the lifting motor 39 or to the electronic system 16B.

Turning now to FIG. 1C, the crane game 10 is shown with a simplified lifting hook arrangement. For clarity, some of the elements are not numbered to facilitate the numbering of the additional structures not shown in FIG. 1A. In discussing FIG. 1C, the differences from FIG. 1A are discussed and it is understood that, unless otherwise noted, FIG. 1C includes the structures of FIG. 1A and operates in like manner. Instead of lifting hooks 30, lifting cords 38, and lifting hook handles 40, the crane 10 includes a single lifting hook 32 which is rigidly attached to the crane body 14. The single lifting hook 32 may be attached to the side of the crane body 14 and may extend laterally from the crane body 14. Thus, the single lifting hook 32 is operated directly by movement of the crane body 14 via crane movement handles 18 and cords 22. The single lifting hook 32 is used in combination with a payload object 54, an origin receptacle 58A, and a destination receptacle 58B. The payload object 54 may be a ball or an egg shaped object. The game is typically started with the payload object 54 in the origin receptacle 58A as shown. The crane 10 is maneuvered into place to slide the single lifting hook 32 underneath the payload object 54 and capture the payload object 54. The crane 10 is then lifted and maneuvered to position the payload object 54 in the destination receptacle 58B. This version of the game is suitable for younger people and is quite simpler than the version shown in FIG. 1A.

FIGS. 2 through 8 show the various parts of the crane 10 and game pieces. For clarity, multiple identical pieces such as multiple handles 18 are not shown where the crane 10 includes multiples of these pieces. Instead, a single piece is shown. It is understood that the crane 10 may use multiple of the same type of piece such as crane movement handles 18, lifting hooks 30, and hook lifting handles 40.

Figure 2:
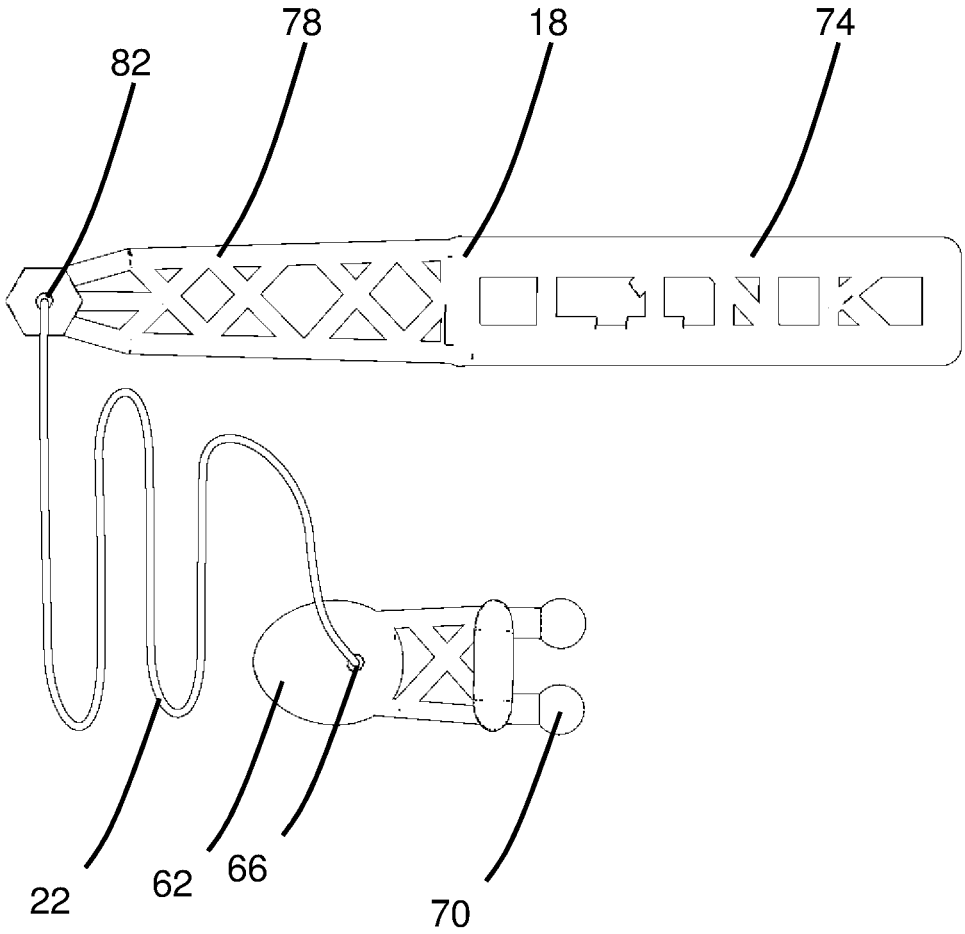
FIG. 2 is a top view drawing which shows a crane movement handle.

FIG. 2 shows a top view of the crane movement handles 18. Each movement handle 18 is attached to a crane movement cord 22 which is in turn attached to the crane body 14. In the example handle 18, the crane cord 22 is attached to a connector 62 which may be attached to or separated from the crane body 14. The connector 62 includes a hole 66 which receives the cord 22. The connector 62 also includes one or more fingers 70 that extend therefrom and engage sockets on the body 14 to attach the connector to the body. If the crane body was formed without removable connectors 62, the hole 66 and other necessary structures would be part of the body 14. The movement handle 18 includes a hand grip 74 which is grasped in the hand of a person operating the crane game and maneuvered to move the crane body 14. The handle also includes a neck 78 extending from the hand grip 74 and a hole 82 formed near the distal end of the handle 18. The cord 22 is attached to the hole 82. The design of the handle 18 may be varied in its aesthetics. As mentioned, the length and elasticity (or lack thereof) of the cord 22 may be varied to change the level of difficulty encountered in using the crane game 10.

Figure 3A:
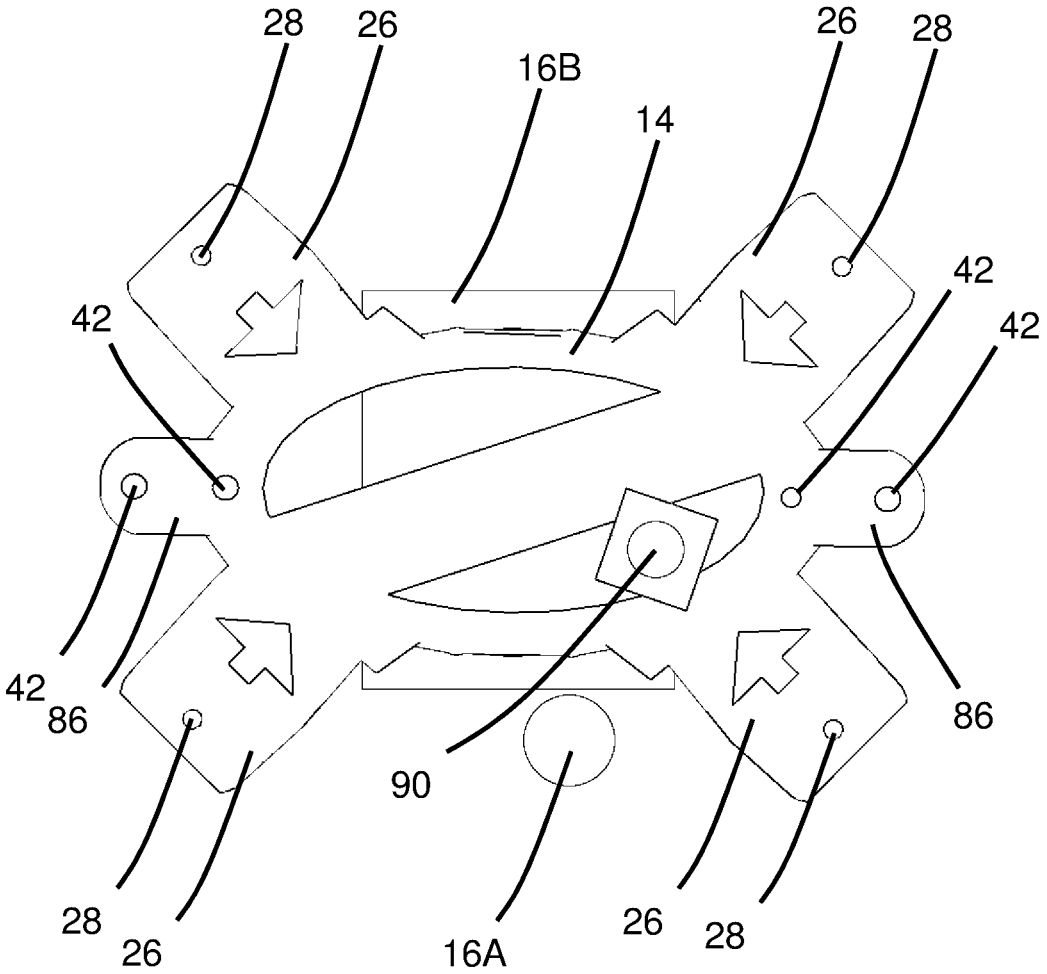
FIG. 3A is a top view drawing which shows the crane body.

FIG. 3A shows a top view of the crane body 14. The body 14 is formed as a relatively flat deck and includes attachment locations for the handles 18 and for the lifting hooks 30. The body 14 includes arms 26 which extend from the body 14 and are used to attach the handles 18. In the example crane 10, the ends of the arms 26 are formed with sockets which receive fingers 70 on the mounting connectors 62 to connect to the mounting connectors 62 to the arms 26. The mounting connectors 62 are attached to the cords 22 used to connect the handles 18 to the body 14. This configuration allows the crane 10 to be changed; possibly using only three handles 18 or substituting different handles 18 such as rigid handles which directly attach to the arms 26 without a cord 22. This may allow for a more difficult or easier to use version of the crane 10 and may allow users to select a level of difficulty for the crane 10 and change the level of difficulty later by using cords 22. Alternatively, the arms 26 extending from the body 14 may directly connect to the cords 22, such as via holes 28. The number of crane movement handles 18 may be varied to change the difficulty of the game and to change the number of persons playing the game. For example, fewer handles 18 such as three handles 18 may be used or more handles 18 than four may be used.

The body 14 also provides a support and attachment for the lifting lines 38. As shown, the body 14 has holes 42 which allow the lifting lines 38 to slide smoothly therethrough. The lifting line holes 42 are located on arms 86 extending outwardly from the body 14, and multiple lifting line holes 42 may be provided on each arm 86 to allow for customization of the game. Placing the lifting lines 38 at a spacing which does not match the spacing between the bucket handle 46 and pivot arm 50 would make it more difficult to initially connect the hooks 30 the bucket 34.

The body 14 may include a motion/level limiting device. Thus, the body 14 may have a hole 90 which receives a ball 16A. The diameter of the hole 90 is often between about one fourth and about three fourths of the diameter of the ball 16A, and is often between about half and about two thirds the diameter of the ball 16A. This allows the ball 16A to rest securely in the hole 90 while still falling out of the hole if the body 14 is tilted more than a desired amount. In another example, the body 14 may include an electronic system 16B to determine if the body 14 has been improperly moved during the game.

Figure 3B:
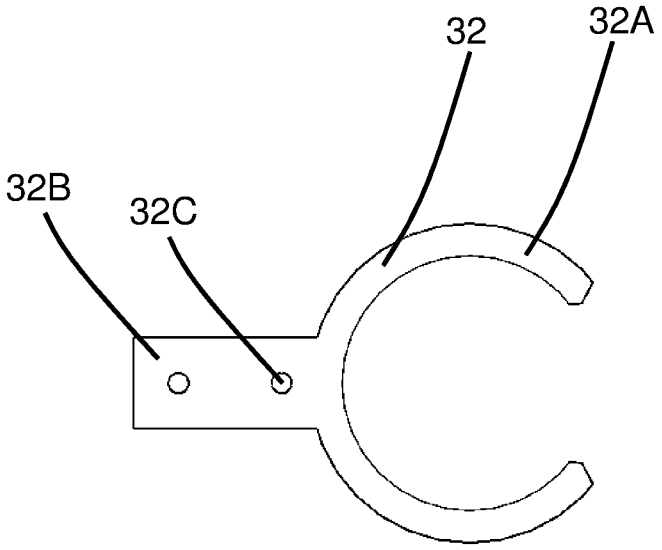
FIG. 3B is a top view drawing which shows the simplified lifting hook.

FIG. 3B shows a top view of the single lifting hook 32. The single lifting hook 32 includes a generally "C" shaped hook member 32A which can be maneuvered beneath a payload object and lifted to capture the payload object. The single lifting hook 32 also includes an attachment plate 32B which extends from the hook member 32A and is used to attach the single lifting hook 32 to the crane body 14. The attachment plate 32B may include one or more holes 32C which may be bolted to the lifting cord holes 42 in the crane body 14. In this way, the crane 10 may be alternately configured for the different manners of game play.

Figure 3C:
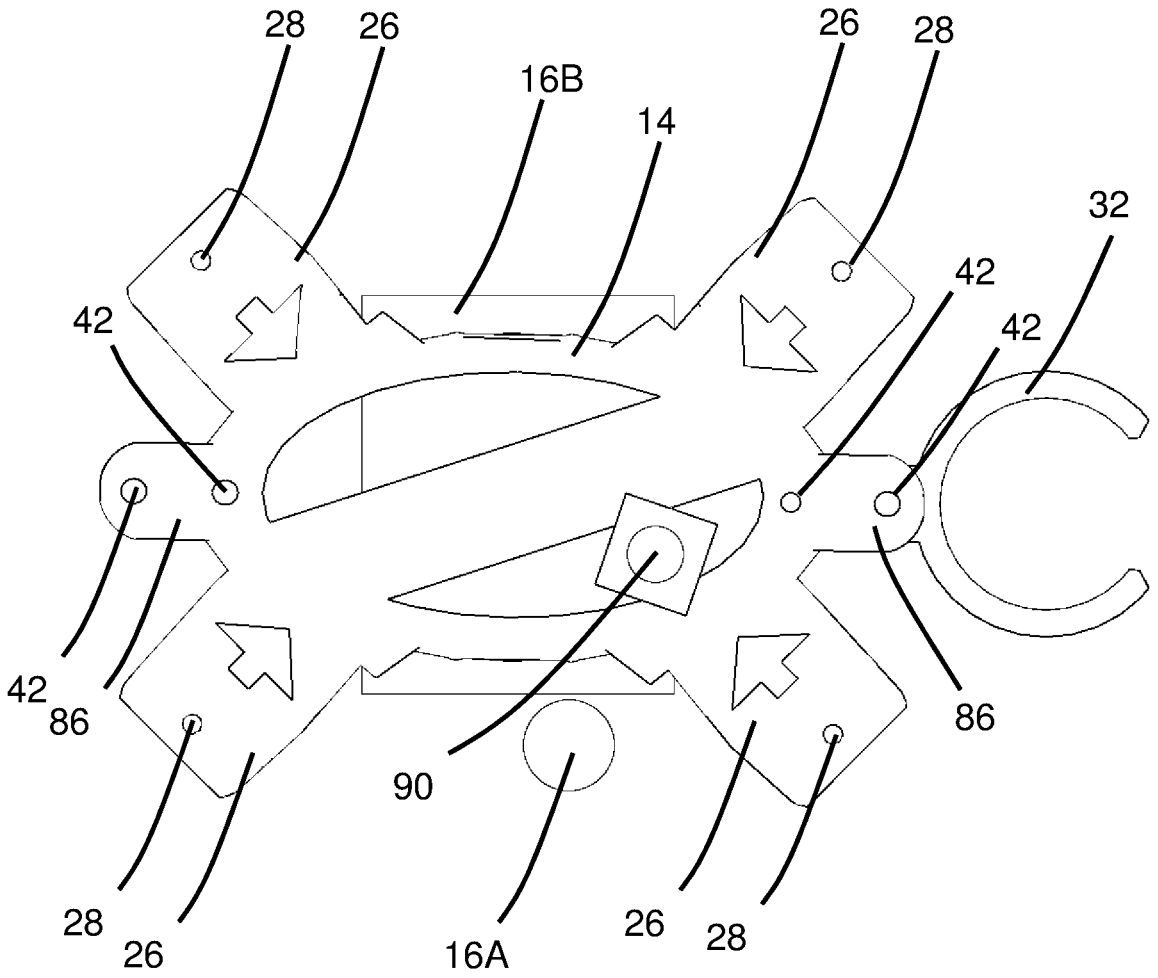
FIG. 3C is a top view drawing which shows the crane body with the simplified lifting hook attached to the crane body.

FIG. 3C shows a top view of the crane body 14 with the single lifting hook 32 attached thereto. As has been discussed, the crane 10 is used by moving the crane body 14 and single lifting hook 32 laterally towards a payload object so that the opening in the lifting hook member passes beyond a lower portion of the payload object 54 and places the payload object 54 above the opening in the single lifting hook 32. The crane body 14 may then be lifted to capture the payload object in the single lifting hook 32.

Figure 4:
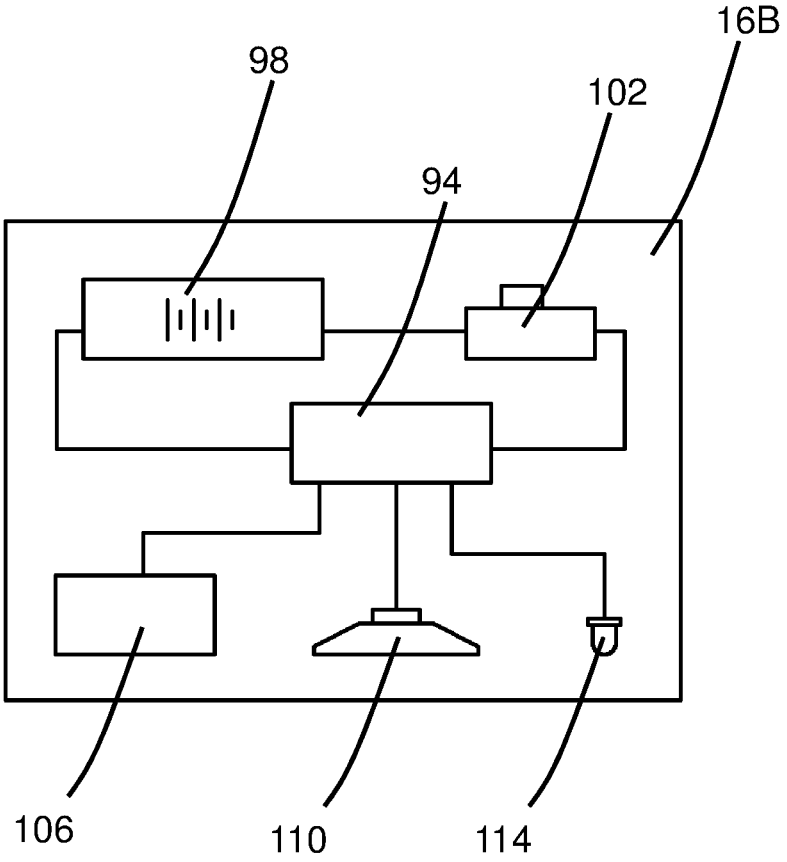
FIG. 4 is a schematic drawing which shows the crane electronic monitoring system.

FIG. 4 shows an example schematic view of such an electronic system 16B. The system need not be complex, and may include a microprocessor 94, battery 98, switch 102, sensor 106, speaker 110 or another audible emitter, and an LED 114 or another visual emitter. The switch 102 turns the system on or off and electrically connects the battery 98 to the microprocessor 94 and other desired components. The sensor 106 may be a gyro, accelerometer, or level sensor as desired. The microprocessor 94 is programmed to accept the signal generated by the sensor 106 and activate one or more of the speaker 110 or LED 114 if a preset limit is exceeded. In a simple example of the electrical monitoring system 16B, a battery 98, electromechanical level sensor 106, switch 102, and alarm 110 or 114 may be connected electrically. The level sensor may be a ball switch or a mercury tube switch or other electromechanical switch that allows electrical flow if a certain tilt has been exceeded. This system requires no microprocessor and simply allows electricity to flow to the alarm if a tilt angle has been exceeded.

Figure 5:
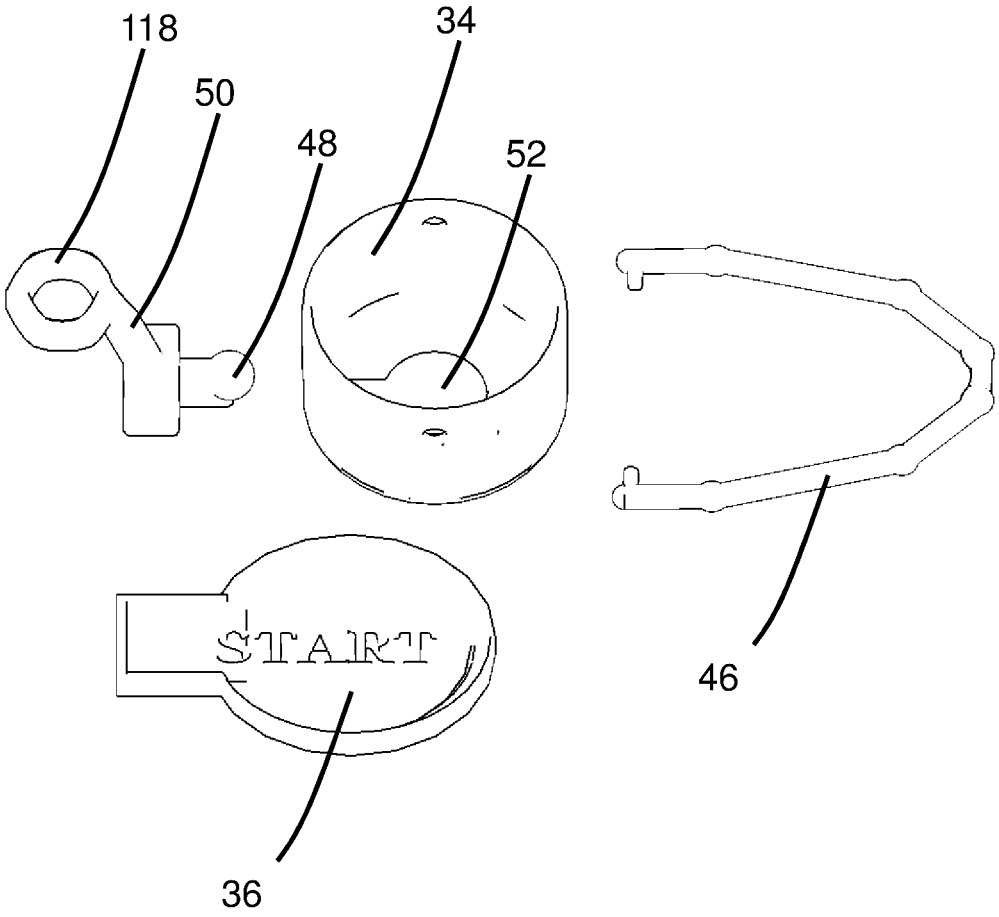
FIG. 5 is a drawing which shows an exploded view of the crane bucket.
Figure 6:
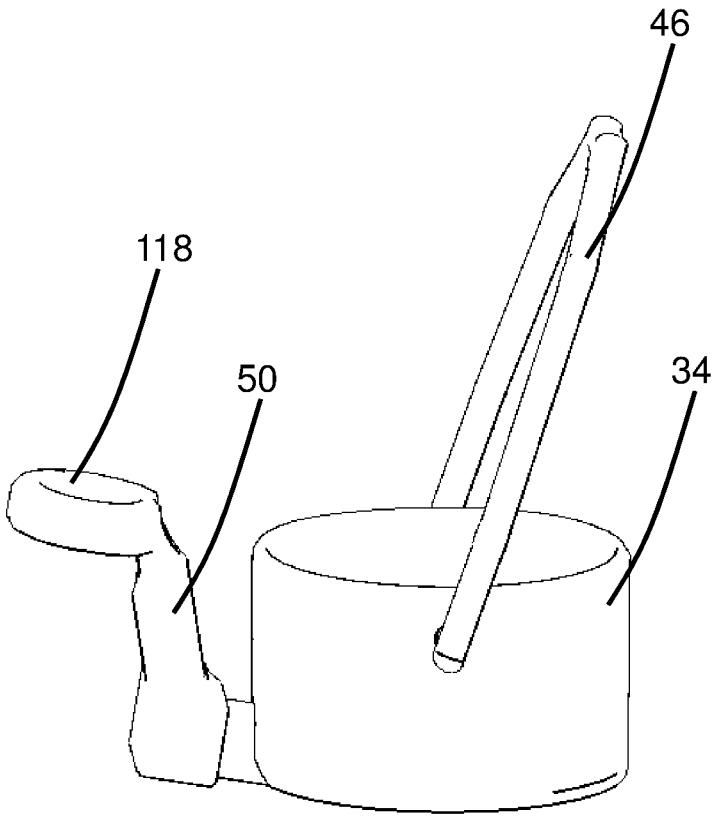
FIG. 6 is a drawing which shows an assembled view of the crane bucket.

FIG. 5 shows an exploded view of the bucket 34; showing the bucket 34, handle/bale 46, and pivot arm 50. The starting pad 36 is also shown. The bucket 34 is provided with a movable bale/handle 46. If desired, a stationary lifting handle 46 could be provided so long as it does not prevent capture/deployment of the payload object 54 with the bucket 34. The bucket pivot arm 50 may be a separate piece or may be an integral part of the bucket 34. The pivot arm typically extends from the bucket 34 in a direction perpendicular to the lifting handle 46 if a planar lifting handle is used. Generally, the lifting handle 46 is positioned near the center of mass of the bucket 34 to support the weight of the bucket 34 and the pivot arm 50 extends away from the bucket to give dumping/scooping control over the bucket while pivoting the bucket about the lifting handle 46. The pivot arm 50 is formed with an open eye 118 or a similar opening that can be engaged by the lifting hook 30 to control the bucket 34. The pivot arm 50 may be designed so that the eye 118 is high enough to be engaged by the hook 30 and low enough to allow it to dump the bucket 34. The pivot arm 50 and bucket 34 may also be designed to allow the pivot arm 50 to rotate and pivot with respect to the bucket 34. This may be accomplished by forming a ball connector 48 on the end of the pivot arm as shown and forming a corresponding keyhole opening 52 on the bottom of the bucket 34 (shown) with a slot which extends to and upwards into the side of the bucket to allow the pivot arm 50 to be connected to the bucket without constraining the movement of the pivot arm 50. The starting pad 36 may be a generally flat pad with a rim formed around it that keeps the bucket 34 from sliding off of the pad. The starting pad 36 can be used to keep the pivot arm 50 in an upright position before it is engaged by a hook 30. FIG. 6 shows an assembled view of the bucket 34.

Figure 7:
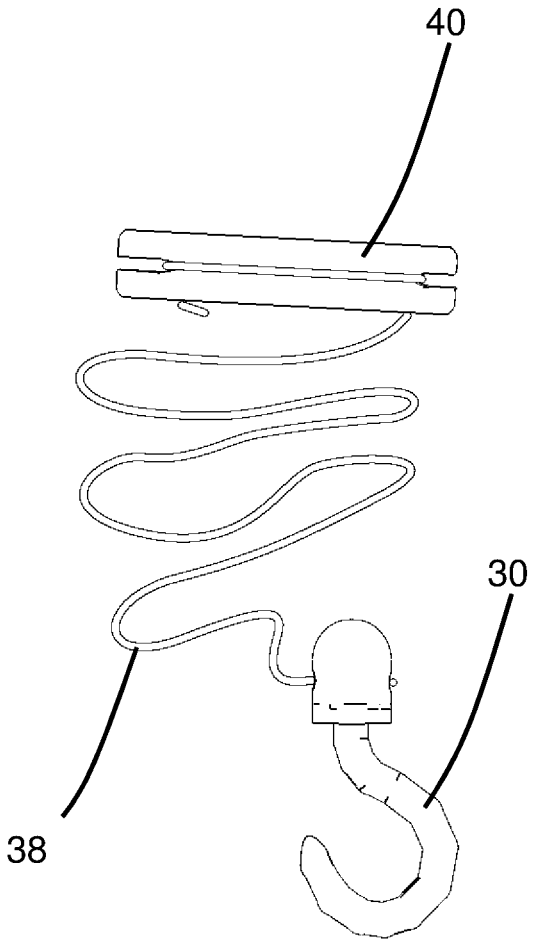
FIG. 7 is a drawing which shows a crane lifting hook.

FIG. 7 shows the lifting hooks 30. The lifting hooks 30 include a hook and a head portion that provides for attachment to the lifting line 38. The hook head may include a hole therethrough that receives the lifting line 38. A handle 40 is attached to the far end of the lifting line 38. The handle may be a cylindrical member with slots formed in the ends to allow the lifting line 38 to be wound around the handle 40. This allows for some adjustment of the length of the lifting line 38. The hook 30 is made with sufficient weight to allow the weight of the hook 30 to pull and move the lifting line 38 and allow the hook to descend from the body 14 in a controlled manner. The lifting line 38 is sufficiently smooth and flexible to allow it to move smoothly through the body 14 in response to use input. Typically, the lifting line 38 is inelastic to allow for greater control over the hook 30, but may be elastic to increase the difficulty of the game if desired.

Figure 8:
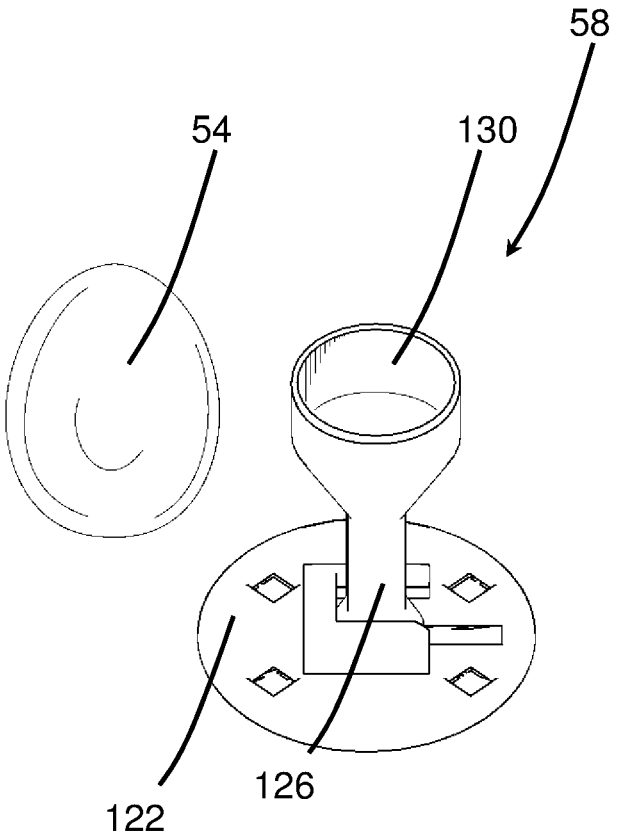
FIG. 8 is a drawing which shows the crane payload object and destination receptacle.

FIG. 8 shows the payload object 54 and destination receptacle 58. The payload object 54 may be a ball or an egg shaped object. Often, the game begins with the payload object 54 in the bucket 34. If desired, the payload object 54 may be out of the bucket and require the persons playing the game to capture the payload object 54. This provides a challenge in capturing the object as it will readily roll in many directions. Other payload objects may be used according to the challenge desired. The destination receptacle 58 may be altered to provide a desired degree of challenge. A simple bowl-shaped receptacle may provide an easy target for placement of the payload object 54. The destination receptacle 58 may be somewhat columnar and may have a base 122, an upright stem 126, and an upper cup or receptacle 130. The size of the receptacle 130 with respect to the size of the payload object 54 will determine how difficult it is to place the payload object 54 into the receptacle 130. In one example, the receptacle 130 is slightly smaller in diameter than the payload object 54 so that the payload object 54 rests on top of the receptacle 130.

Figure 9:
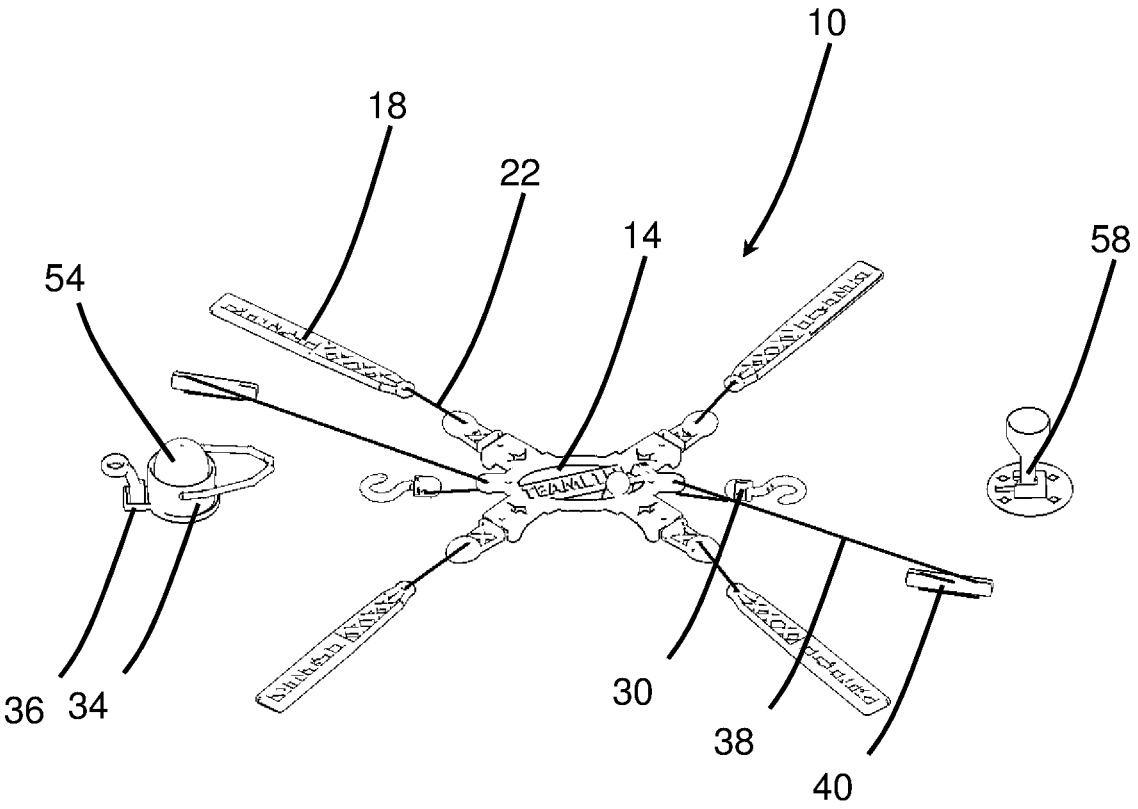
FIG. 9 is a drawing which shows an example of the crane during use.

FIGS. 9 through 13 show an example use of the crane game. For clarity in viewing the elements of the crane 10, many of the structural elements discussed above are not numbered. FIG. 9 shows an example starting configuration for an activity using the crane 10. The crane 10 may be placed in a starting location with its body 14, handles 18, etc. The bucket 34 may be placed in a different location on top of the starting pad 36 and with the payload object 54 in the bucket 34. The destination receptacle 58 may be placed in yet another location. For clarity, the bucket 34 and destination receptacle 58 are shown relatively close-by but these objects are often placed relatively far apart from each other and from the crane 10. The destination receptacle 58 and crane 10 may be placed relatively close to each other with the bucket 34 place farther away, requiring the persons playing the game to traverse the playing area with the crane 10 to get the bucket 34 and then traverse back with the crane 10 and bucket 34 to get to the destination receptacle 58.

The persons playing the game must grab the crane handles 18 and the lifting cords 38 and use these to lift the crane body 14 and lifting hooks 30 off of the ground. The persons then must move together to move the crane 10 into position over the bucket 34, grab the bucket handle 46 and pivot arm 50, carry the bucket 34 and payload object 54 to the destination receptacle 58 (e.g. a finish goal), and place the payload object 54 into the destination receptacle 58. Each movement requires close cooperation and coordination between the various individuals. The persons with the crane movement handles 18 must move together to move the crane body 14 and must move to capture an object with the hooks 30. The persons with the hook handles 40 must move with the body 14 since movement of the body 14 without a coordinated movement of the hook handle 40 will raise or lower the hook 30. It is appreciated how the crane game 10 will require close cooperation between the players.

Figure 10:
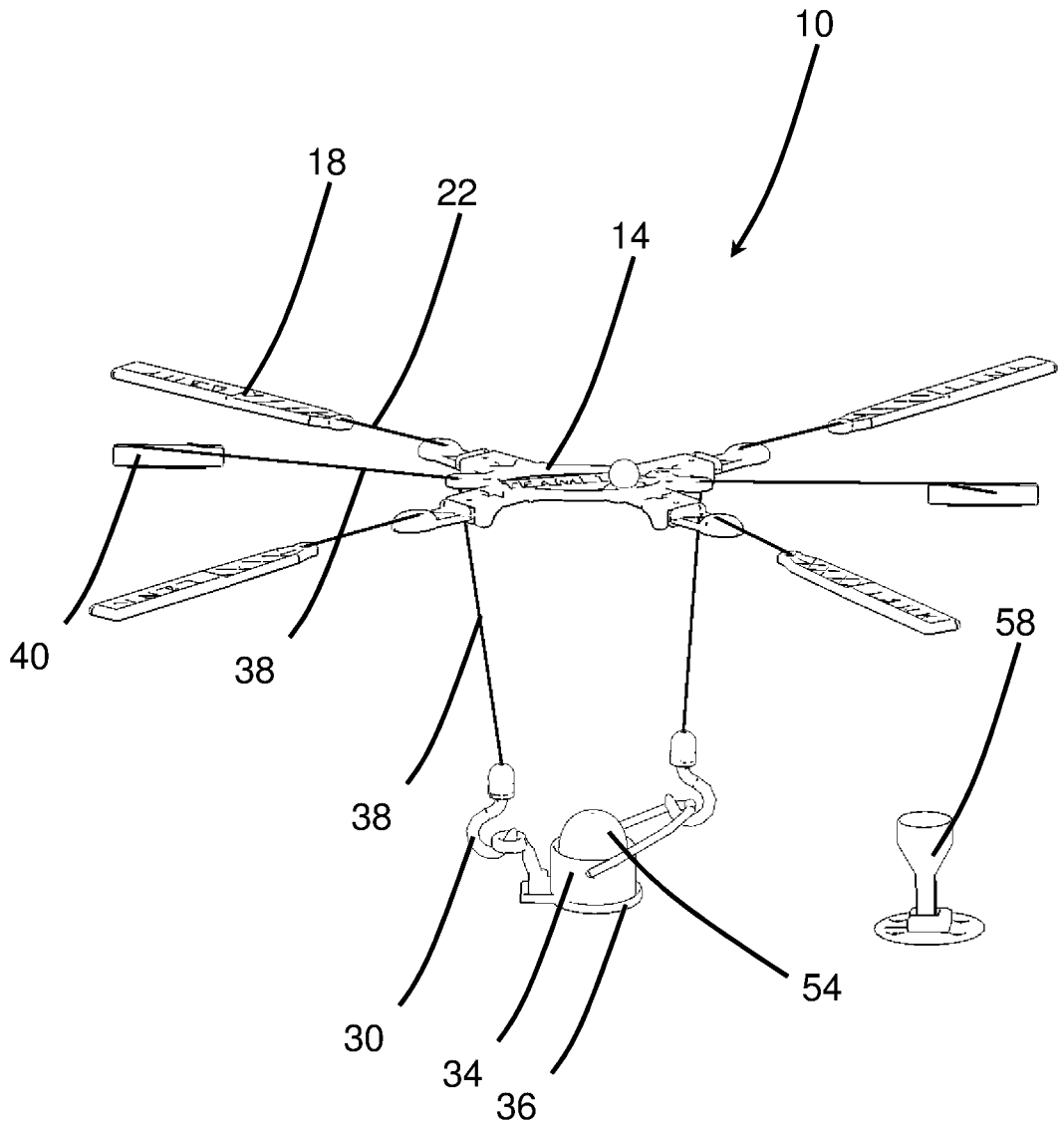
FIG. 10 is a drawing which shows an example of the crane during use.
Figure 11:
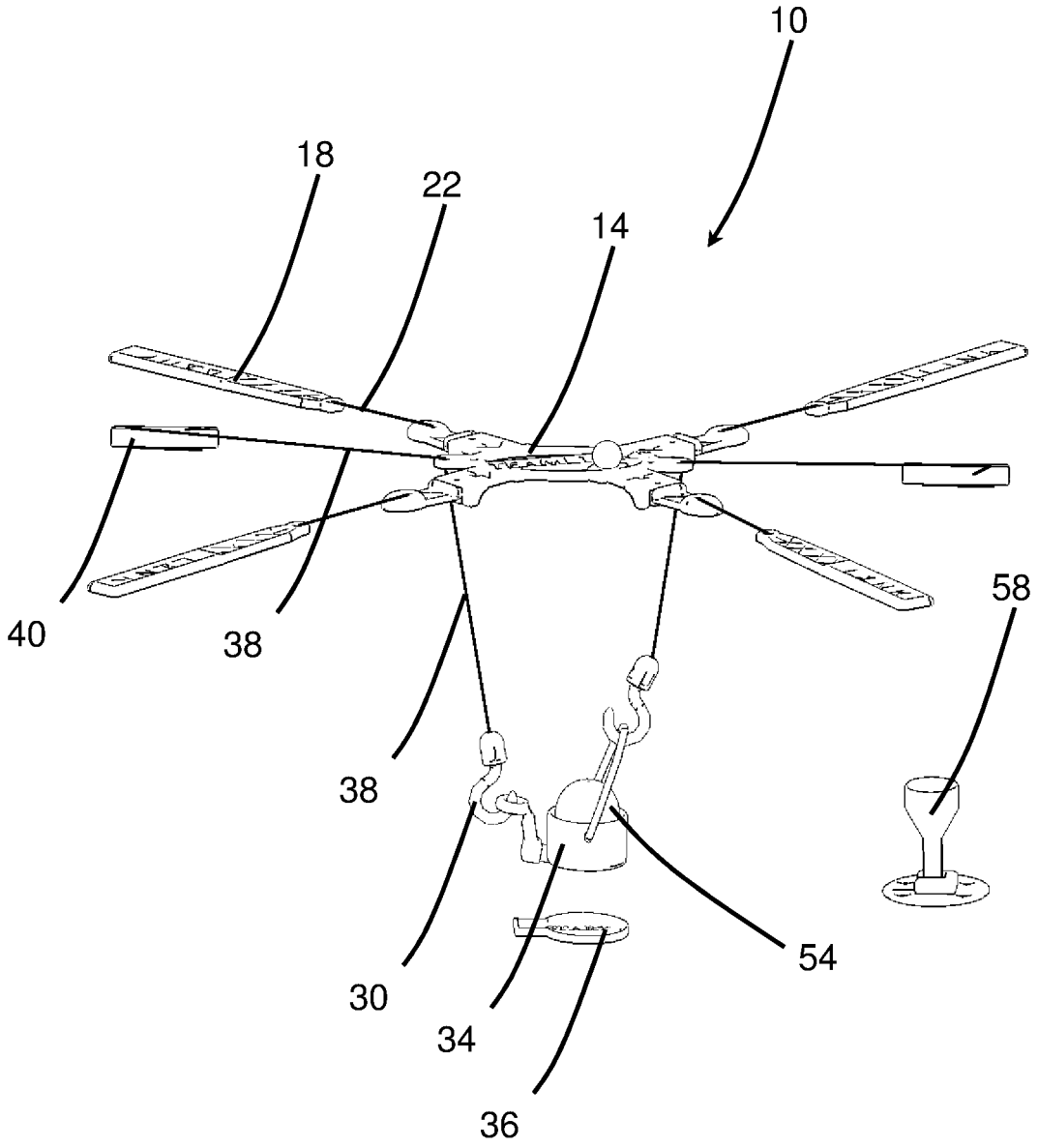
FIG. 11 is a drawing which shows an example of the crane during use.

FIGS. 10 and 11 show the crane 10 during a game where the crane 10 has been successfully used to capture the bucket 34 and payload object 54. The players have moved the crane movement handles 18 and the hook handles 40 to position the crane body 14 above the bucket 34 and to capture the handle 46 and pivot arm 50 with the hooks 30 as shown in FIG. 10. FIG. 11 shows how the players have moved the crane movement handles 18 and hook handles 40 to lift the bucket 34 and payload object 54 off of the starting pad 36.

Figure 12:
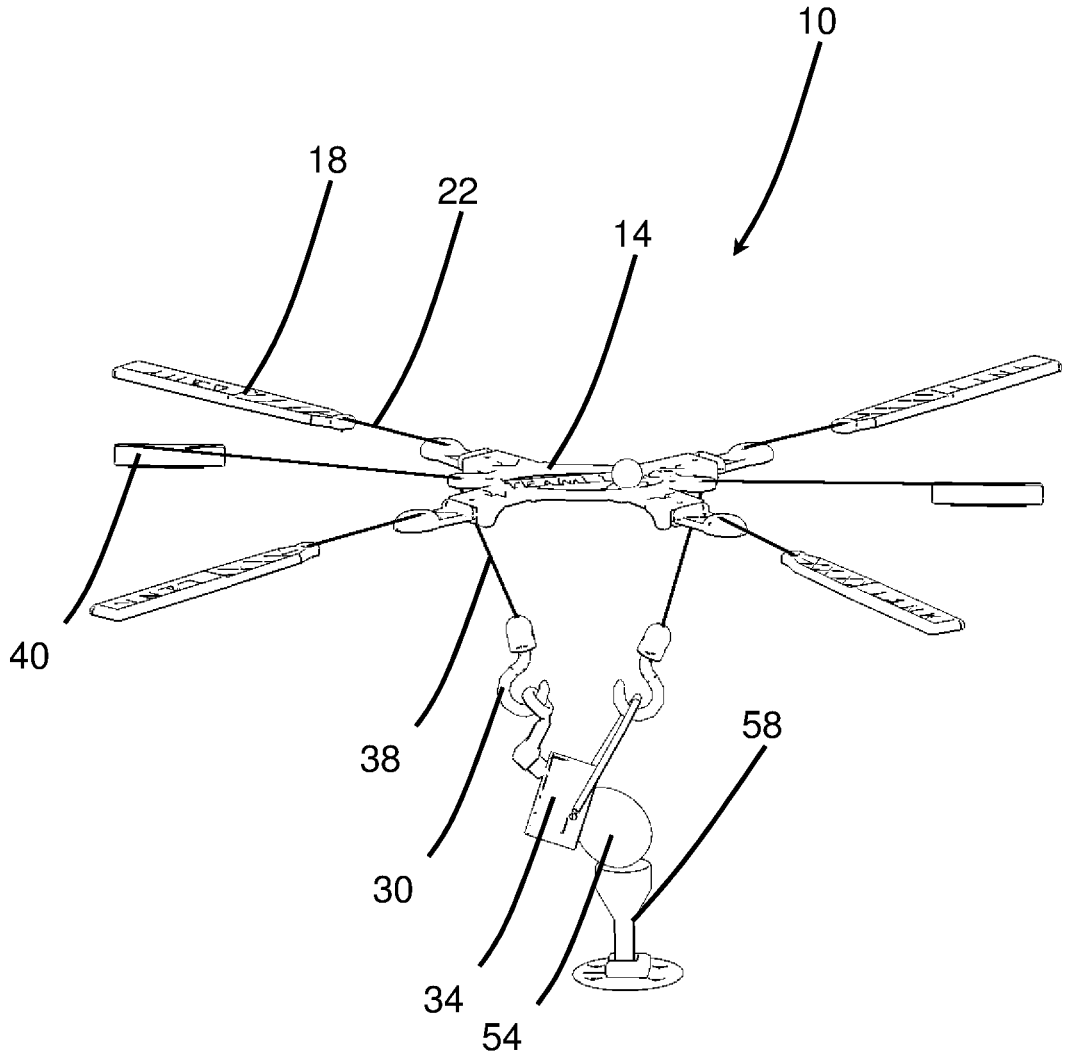
FIG. 12 is a drawing which shows an example of the crane during use.
Figure 13:
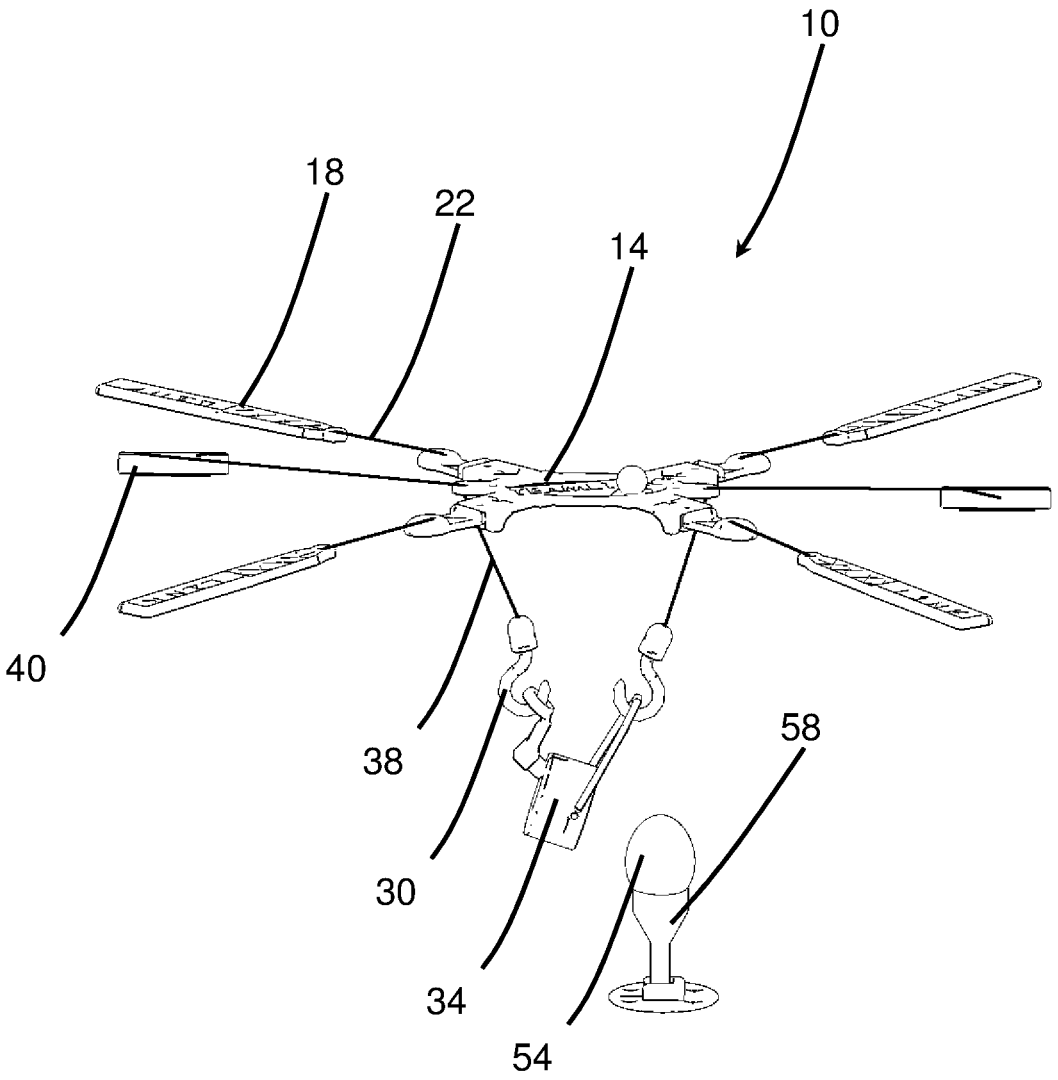
FIG. 13 is a drawing which shows an example of the crane during use.

After capturing the bucket 34 and payload object 54, the persons must move the crane 10 to the destination receptacle 58 without losing the bucket 34 and payload object 54. Once they are positioned above the destination receptacle 58, the persons must carefully maneuver the bucket 34 down to the destination receptacle 58 and tilt the bucket 34 using the hook lifting handles 40 to dump the payload object 54 into the destination receptacle 58. FIG. 12 shows the crane 10 while the bucket 34 is being tilted to dump the payload object 54 into the destination receptacle 58. FIG. 13 shows the game after the crane 10 has been used successfully to place the payload object 54 into the destination receptacle 58.

As discussed, the crane game 10 provides a challenge in use. As multiple people each control one of the hook handles 40 or crane movement handles 18, each person must move in coordination with the other persons so that movement of the crane 10 does not result in unintended tipping of the bucket 34 and loss of the payload object 54. The crane 10 requires active communication between participants and coordination of efforts. Accordingly, the crane 10 provides a fun recreational game and also provides a valuable training and team building exercise.

The above description of illustrated examples of the present invention, including what is described in the Abstract, are not intended to be exhaustive or to be limiting to the precise forms disclosed. While specific examples of the invention are described herein for illustrative purposes, various equivalent modifications are possible without departing from the broader scope of the present claims. Indeed, it is appreciated that specific example dimensions, materials, etc., are provided for explanation purposes and that other values may also be employed in other examples in accordance with the teachings of the present invention.

What is claimed is:

1. A game comprising:

a crane body;

a plurality of manually grasped crane movement handles, wherein each of the plurality of crane movement handles is attached to a cord and wherein the cord is also attached to the crane body; and wherein the crane body is suspended between the plurality of crane movement handles;

a first lifting hook suspended beneath the crane body by a first lifting line;

wherein the first lifting line extends upwardly from the first lifting hook to the crane body, engages the crane body, and extends outwardly from the crane body;

a second lifting hook suspended beneath the crane body by a second lifting line;

wherein the second lifting line extends upwardly from the second lifting hook to the crane body, engages the crane body, and extends outwardly from the crane body;

wherein the first lifting line and second lifting line are manually graspable and movable laterally towards and away from the crane body to lower and raise the respective first and second lifting hook relative to the crane body;

a bucket having a lifting attachment attached thereto and having a pivoting attachment attached thereto;

wherein the bucket lifting attachment is engaged by the first lifting hook and the bucket pivoting attachment is engaged by the second lifting hook such that the bucket is suspended beneath the crane body by the first lifting hook and the second lifting hook; and wherein each of the plurality of crane movement handles is positioned laterally away from the crane body in different directions.

2. The game of claim 1, wherein each cord attaching a crane movement handle to the crane body is an elastic cord.

3. The game of claim 1, further comprising a first hook handle attached to the first lifting line and a second hook handle attached to the second lifting line.

4. The game of claim 1, further comprising;

a payload object disposed in the crane bucket; and a destination receptacle separate from the crane; and wherein the first lifting hook and the second lifting hook are moved independently to tilt the bucket and place the payload object in the destination receptacle.

5. The game of claim 1, further comprising a ball and a hole formed in the crane body which has a diameter which is smaller than a diameter of the ball, wherein the ball is placed in the hole on the crane body, and wherein the ball will fall off of the crane body of the crane body is tilted past a predetermined angle.

6. The game of claim 1, further comprising an electronic motion sensing circuit which senses movement of the crane body and which creates an alarm if the crane body is tilted past a predetermined angle.

7. A game comprising:

a crane body;

a first manually grasped crane movement handle, wherein the first crane movement handle is attached to a first end of a first cord and wherein a second end of the first cord is attached to the crane body;

a second manually grasped crane movement handle, wherein the second crane movement handle is attached to a first end of a second cord and wherein a second end of the second cord is attached to the crane body;

wherein the crane body is suspended from the first crane movement handle and the second crane movement handle;

a first lifting hook;

a first lifting line having a first end which is attached to the first lifting hook and wherein the first lifting line extends upwardly from the first lifting hook to the crane body, engages the crane body, and extends outwardly from the crane body such that a second end of the first lifting line is disposed laterally from the crane body;

a second lifting hook;

a second lifting line having a first end which is attached to the second lifting hook and wherein the second lifting line extends upwardly from the second lifting hook to the crane body, engages the crane body, and extends outwardly from the crane body such that a second end of the second lifting line is disposed laterally from the crane body;

wherein the first movement handle and the second movement handle are each grasped by a person and held such that the crane body is suspended by the first cord and the second cord;

wherein the first lifting line and second lifting line are each grasped by a user and moved laterally towards and away from the crane body to lower and raise the first lifting hook and the second lifting hook relative to the crane body.

8. The game of claim 7, wherein the game further comprises:

a bucket having a lifting attachment attached thereto and having a pivoting attachment attached thereto; and wherein the bucket lifting attachment is engaged by the first lifting hook and the bucket pivoting attachment is engaged by the second lifting hook such that the bucket is suspended beneath the crane body by the first lifting hook and the second lifting hook.

9. The game of claim 8, wherein the game further comprises:

a payload object disposed in the bucket; and a destination receptacle comprising a base and an upwardly extending portion having a cavity formed in a top thereof, and wherein the payload object may be placed in the cavity.

10. The game of claim 7, wherein the first cord, the second cord, the first lifting line, and the second lifting line each extends laterally away from the crane body in different directions.

11. The game of claim 7, wherein the game further comprises:

a first lifting handle attached to the second end of the first lifting line; and a second lifting handle attached to the second end of the second lifting line; and wherein the first lifting handle and the second lifting handle are each grasped by a user.

12. The game of claim 7, wherein the game further comprises a hole formed in a top of the crane body and a ball; wherein the ball is larger in size than the hole; and wherein the ball is located in the hole and will fall off of the crane body if the crane body is tilted more than a predetermined angle from level.

13. The game of claim 7, further comprising an electronic monitoring circuit having an angle sensor and an alarm generator, wherein the electronic monitoring circuit is attached to the crane body, and wherein the electronic circuit generates an alarm if the crane body is tilted more than a predetermined angle from level.

14. The game of claim 7, further comprising:

a third manually grasped crane movement handle, wherein the third crane movement handle is attached to a first end of a third cord and wherein a second end of the third cord is attached to the crane body; and a fourth manually grasped crane movement handle, wherein the fourth crane movement handle is attached to a first end of a fourth cord and wherein a second end of the fourth cord is attached to the crane body; and wherein the third movement handle and the fourth movement handle are each grasped by a person and held such that the crane body is suspended by the first cord, second cord, third cord, and the fourth cord with the first cord, second cord, third cord, and the fourth cord extending laterally from the crane body in different directions.

* * * * *